US006564396B1

(12) United States Patent
Pitts

(10) Patent No.: US 6,564,396 B1
(45) Date of Patent: May 20, 2003

(54) CONVERTIBLE TOILET SEAT

(76) Inventor: Ricky Earl Pitts, 154 Johnson Rd., Lawrenceville, GA (US) 30045

( * ) Notice: Subject to any disclaimer, the term of this patent is extended or adjusted under 35 U.S.C. 154(b) by 0 days.

(21) Appl. No.: 09/978,330

(22) Filed: Oct. 16, 2001

(51) Int. Cl.[7] ..... A47K 13/06
(52) U.S. Cl. ..... 4/239
(58) Field of Search ..... 4/235, 237, 239

(56) References Cited

U.S. PATENT DOCUMENTS 557,780 A * 4/1896 Dutro ..... 4/235
2,461,160 A * 2/1949 Joyce ..... 4/235
2,645,784 A * 7/1953 Blackburn ..... 4/235
4,461,046 A * 7/1984 Adams ..... 4/239 X
5,842,234 A * 12/1998 Dixon ..... 4/235

* cited by examiner

*Primary Examiner*—Charles E. Phillips
(74) *Attorney, Agent, or Firm*—Kilpatrick Stockton LLP

(57) ABSTRACT

A convertible toilet seat and the method for its use, including a child seat section that is rotatably attached to a posterior section of the convertible toilet seat. The child seat section fits receivably onto an anterior section of the toilet seat. By lowering the child seat section, a typical adult user thereby increases the size of the aperture to accommodate his or her use. By raising the child seat section, a small user such as a young child creates a smaller aperture in the toilet seat to accommodate his or her use. The convertible toilet seat may be a separate component of a conventional toilet, or may be integral to a unitary toilet.

21 Claims, 3 Drawing Sheets

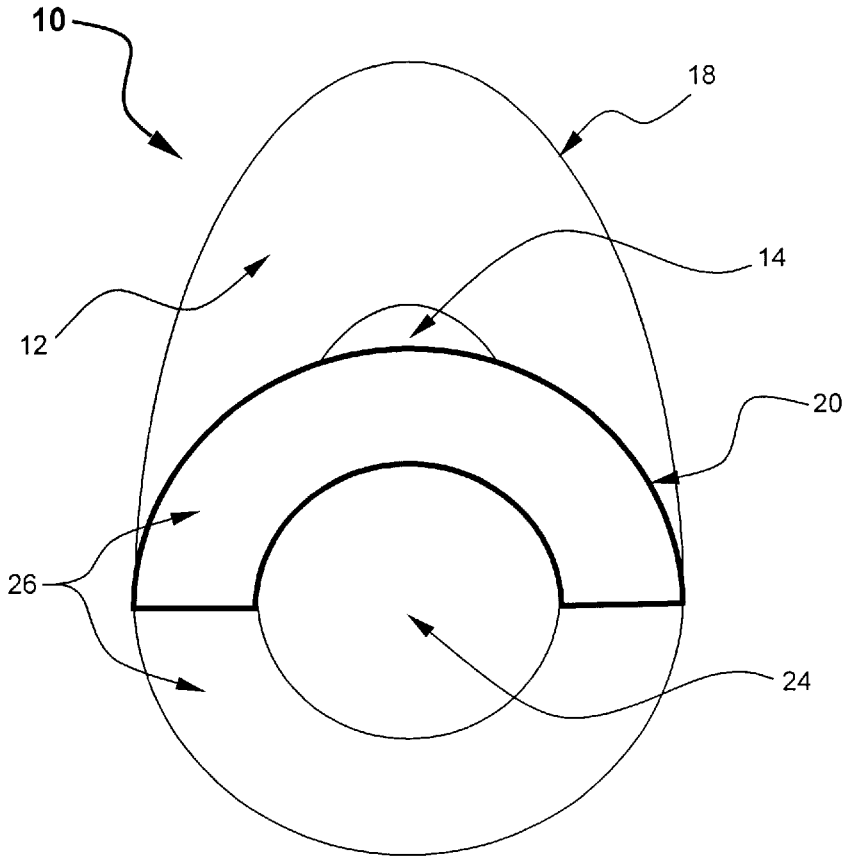
FIG. 4
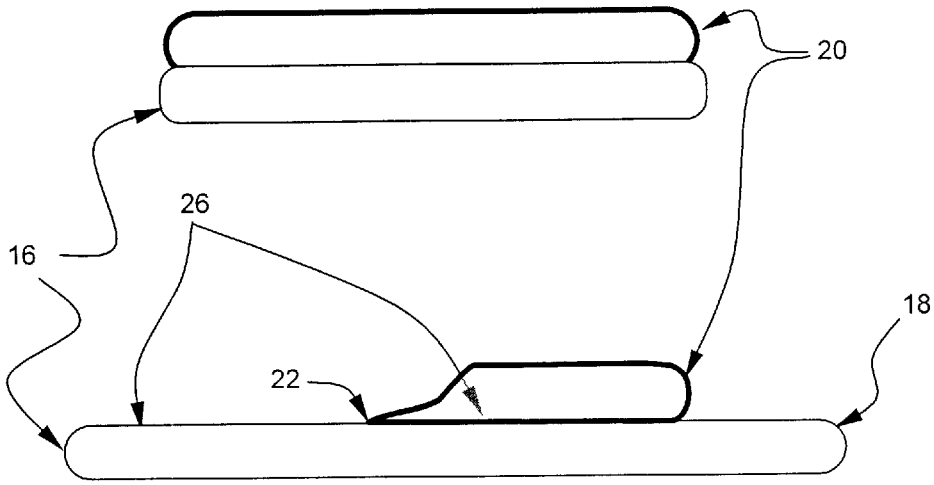
FIG. 5
FIG. 6

CONVERTIBLE TOILET SEAT

FIELD OF THE INVENTION

The present invention relates generally to toilet seats, and more specifically, to a toilet seat of changeable size for use by both children and adults.

BACKGROUND OF THE INVENTION

Adults and small children sharing the same household or public toilet seats facilities typically must contend with difficulties presented by the disparities in their respective sizes; toilet seats are generally designed with the anatomy of adults in mind. However, small children that are beyond the age of potty-chair training but are still significantly smaller than adults often have trouble maintaining a sitting position on adult-sized toilet seats. This is because the opening in the toilet seat is generally too large for small children to maintain contact with enough toilet seat surface area. This results in small children often having to hold themselves on the seat by grasping it with their hands, which can be uncomfortable, unnerving, and unsanitary.

Various forms of toilet seats, toilet seat assemblies, and toilet seat adaptors have been devised with the objective of solving this problem by providing a relatively smaller seat opening. Existing solutions include adding a removably or permanently mounted child seat to an existing adult toilet seat, or replacing the existing adult seat with a combination child/adult toilet seat assembly. Removably mounted child seats can be unstable and difficult to attach and detach, and must be stored between uses. A permanently mounted child seat impedes adult use of the toilet if it is used to replace the adult-sized toilet seat, and it eventually has to be replaced. Removably and permanently mounted toilet child seats and combination child/adult assemblies disclosed in the prior art generally comprise a structure where the child seat is overlaid upon the adult seat, such that the child seat may be flipped up for access to the adult seat. However, mounted child seats and combination child/adult assemblies typically raise the height of the toilet seat surface, which makes seating themselves more difficult for small children. Adults may also find it uncomfortable to use the adult-sized seat with the child seat up and against their backs.

The prior art also discloses a combination child/adult assembly where the size of the seat opening can be adjusted by laterally moving the sides of the toilet seat closer together or further apart. Because such a device requires motor skills beyond the capacity of the typical child user, an adult must assist in converting the seat for the child's use.

Another prior design contemplates an adult seat with a "half seat" mounted at its rear. When the half seat is flipped down on top of the adult seat, it reduces the size of the seat opening. However, as with the aforementioned attempts to solve this problem, a small child has to reach over the open toilet bowl and lower the seat if it is found in the upright position. The distance from the front rim of a toilet to a raised toilet seat can exceed two feet for a full-sized seat, or approximately 1.5 feet for a half seat. Any inability to safely and easily reach and lower the seat without adult assistance is contrary to the goal of encouraging a child's independence during toilet training. Furthermore, a half seat may create discomfort for a person using the adult seat with the half seat in its raised position.

What is needed is a toilet seat that easily accommodates both adults and children, is quick and simple for a child to convert without adult assistance, and that safe, comfortable, and sanitary. It is also advantageous to have a toilet seat that need not be replaced when there are no more small children in the household.

SUMMARY OF THE INVENTION

The present invention solves the needs identified above. The toilet seat of this invention is convertible to accommodate individuals of various sizes, ranging from small children to adults. It has the advantage of providing a smaller seat opening for small children without increasing the height of the seat surface. It is easily convertible because its conversion mechanism does not require a long reach or significant strength, and because conversion can be accomplished in one motion and using one hand. Another advantage is that the entire apparatus of this invention is substantially returned to the outward appearance of an ordinary adult-sized toilet seat when it has been converted for adult use. The present invention is usable with a conventional toilet, or as a component of a unitary toilet.

Generally described, the present invention includes a convertible toilet seat. More specifically described, the toilet seat includes a substantially planar surface, having a substantially centrally located aperture. The central aperture is essentially the diameter of the central aperture in a conventional toilet. The planar surface includes an anterior section that is less thick in relation to a posterior section of the toilet seat. In the exemplary embodiment of this invention, a child seat section is rotatably attached to the posterior section such that the child seat section is received by the anterior section of the toilet seat. The child seat section is received by the anterior section in an overlaying clam-like configuration, their aggregate thicknesses substantially equaling the thickness of the posterior section. The anterior section may be molded to receive the child seat section. The convertible toilet seat also includes a means of rotatably attaching the child seat section to the posterior section. According to an aspect of the invention, the child seat section may be substantially congruent to the anterior section. The child seat section includes a means of locking in place when in the lowered position. In another embodiment, the child seat section includes a means of locking in place in the raised position. In another embodiment of the present invention, the convertible toilet seat is integral to a unitary toilet.

The present invention is used to convert toilet seat sizes by rotatably attaching a child seat section to a posterior section and above a receiving anterior section of a toilet seat, raising the child seat section to form a child seat with a relatively smaller central aperture, and lowering the child seat section to form an adult seat with a conventional-sized central aperture.

These and other aspects, features, and advantages of the present invention may be more clearly understood and appreciated from a review of the following detailed description of the disclosed embodiments and by reference to the appended drawings and claims.

BRIEF DESCRIPTION OF THE DRAWINGS

FIG. 4 is a plan view of a preferred embodiment of a convertible toilet seat, with the child seat section in the raised position.

FIG. 5 is a front elevation of a preferred embodiment of a convertible toilet seat, with the child seat section in the raised position.

FIG. 6 is a side elevation of a preferred embodiment of a convertible toilet seat, with the child seat section in the raised position.

DETAILED DESCRIPTION OF THE INVENTION

The present invention is directed to a convertible toilet seat, and to a method of converting toilet seat sizes. Briefly described, the convertible toilet seat and the method for its use includes a child seat section that is rotatably attached to a posterior section of the convertible toilet seat. By lowering the child seat section to fit receivably onto an anterior section of the toilet seat, a typical adult user thereby increases the size of the aperture to accommodate his or her use. By raising the child seat section, a small user such as a young child creates a smaller aperture in the toilet seat to accommodate his or her use.

Figure 1:
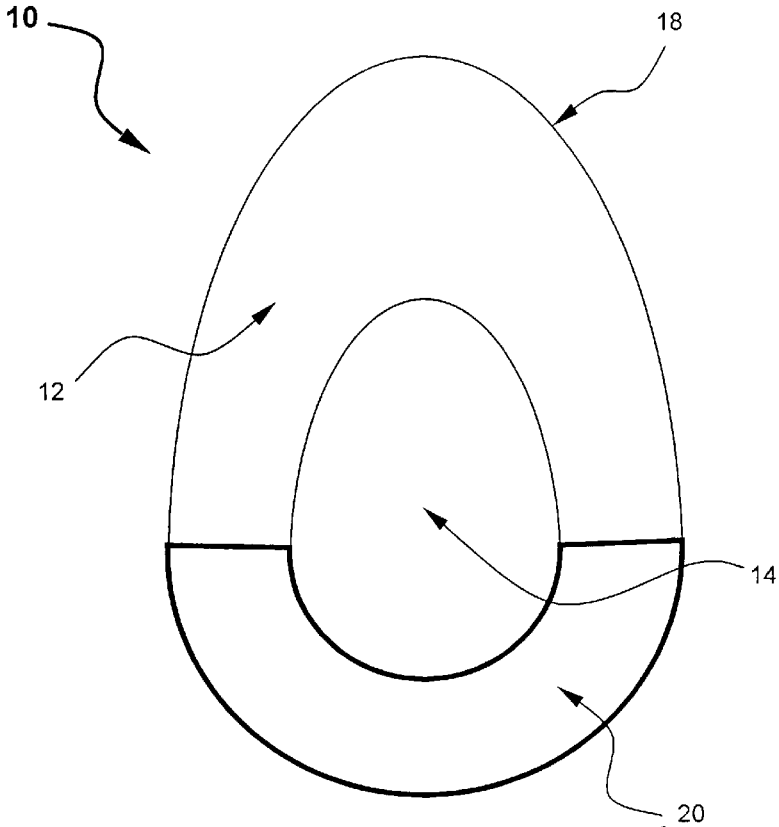
FIG. 1 is a plan view of a preferred embodiment of a convertible toilet seat, with the child seat section in the lowered position.

Referring now to the drawings, wherein like numerals refer to like parts throughout the several views, FIG. 1 illustrates an exemplary convertible toilet seat 10 according to the present invention. Generally speaking, the convertible toilet seat 10 may have substantially the same width and length as a conventional toilet seat. Although the convertible toilet seat 10 illustrated is elongated, the method and apparatus of the present invention is applicable to round, elongated, as well as any other toilet seat shape. The surface 12 of the convertible toilet seat 10 is substantially planar, but may have rounded or beveled edges and may slope or curve ergonometrically.

The convertible toilet seat 10 has a central aperture 14 that is centrally located. The central aperture 14 is essentially the diameter of the central aperture in a conventional toilet, and is typically round or oval, although any other suitable shape or size may be used.

In the exemplary embodiment of the present invention, an anterior section 16 and an adjacent posterior section 18 of the convertible toilet seat 10 are preferably integral parts of a whole, but may also be separate parts that are fastened to one another. The anterior section 16 of the convertible toilet seat 10 has generally the same thickness as the posterior section 18 of the convertible toilet seat 10. In an alternative embodiment (not shown) the anterior section 16 is molded or otherwise shaped to receive a child seat section 20.

Figure 2:
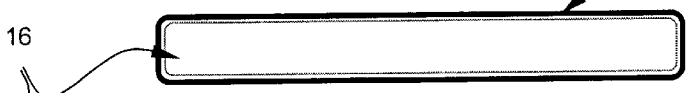
FIG. 2 is a front elevation of a preferred embodiment of a convertible toilet seat, with the child seat section in the lowered position.

Referring now to FIG. 2, in the exemplary embodiment of the present invention, a child seat section 20 is rotatably attached to the posterior section 18 such that the child seat section 20 is received by the anterior section 16 of the convertible toilet seat 10. In the exemplary embodiment, the child seat section 20 is of substantially the same width and length as the anterior section 16 of the convertible toilet seat 10. The child seat section 20 is attached by an attaching means 22 that allows the child seat section 20 to rotate along the juncture between the child seat section 20 and the posterior section 18. The attaching means 22 is preferably a live hinge (such as the hinge utilized in video tape boxes), but by way of example and not limitation may be a hinge, cam, or other means of rotatably attaching the child seat section 20 receivably onto the anterior section 16.

The child seat section 20 is shaped so as to achieve a clam-like fit over the anterior section 16. In other words, the child seat section 20 overlays the anterior section 16 such that the exterior top and exterior side surfaces of the anterior section 16 interface with the underside of the child seat surface 20. It will be understood that the present invention may be alternatively practiced by constructing a child seat section 20 and affixing it at the attaching means 22 directly to an existing base such as a toilet or toilet seat. By way of example and not limitation, a child seat section 20 may be affixed to a conventional seat at the attaching means 22 with a low profile means of affixing such as tape, adhesive, or flush mounted mechanical fasteners, to achieve the identical structure and function as claimed herein.

As FIG. 1 illustrates, when the child seat section 20 is lowered, the convertible toilet seat 10 is configured for adult use. The child seat section 20 is received by the anterior section 16, and their aggregate thicknesses approximate the thickness of the posterior section 18. Referring now to the example shown in FIG. 3; when a user rotates the child seat section 20 to its lowered position, the upper surface of the child seat section 20 is substantially aligned with the upper surface of the posterior section 18 of the convertible toilet seat 10 such that a relatively seamless surface 12 is formed. In this manner, the convertible toilet seat 10 has substantially the look and feel of conventional toilet seat when the child seat section 20 is lowered.

Alternatively, when the child seat section 20 is raised, the convertible toilet seat 10 is configured for use by a small individual. Referring now to FIGS. 4, 5 and 6, the child seat section 20 is rotated from its lowered position to its raised position. The child seat section 20 can rotate at least 90 degrees from its horizontal position. The child seat section 20 may form a vertically- or diagonally-oriented backrest for a child user, in which case the child user sits on a partial section of the surface 26. In the exemplary embodiment of the present invention, the upper surface of the child seat section 20 lies flat upon the upper surface of the posterior section 18 of the convertible toilet seat 10, in which case the child user sits directly on a full section of the surface 26, as shown in FIG. 6.

Figure 3:
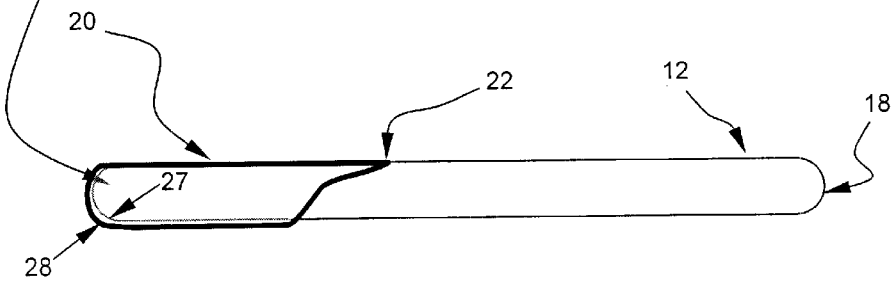
FIG. 3 is a side elevation of a preferred embodiment of a convertible toilet seat, with the child seat section in the lowered position.

FIGS. 3 and 6 also illustrate the attaching means 22 for attaching child seat section 20 to the posterior section 18. It will be understood by those skilled in the art that the attaching means 22 may be a hinge, cam, or other means of attaching. Preferably and in the exemplary embodiment of the present invention, the attaching means 22 is a specialized hinge such as a double live hinge, which integrally facilitates raising and lowering the child seat section 20, maintaining the child seat section 20 in the raised or lowered position, and achieving a seamless juncture when the child seat section 20 is in the lowered position. The attaching means 22 is integrally molded as a portion of both the child seat section 20 and the convertible toilet seat 10, and has a reduced thickness so as to allow the attaching means 22 to flex. The attaching means may be reinforced such as by a flexible web of fabric, or by other suitable reinforcing material or process. Alternatively, the attaching means 22 and the means for maintaining the position of the child seat section 20 are separate devices. For example, the attaching means 22 may provide the rotational motion of the child seat section 20, while a separate locking mechanism (not shown) may lock the child seat section 20 in place when it has been raised. Further, the attaching means 22 may enable the child seat section 20 to be locked in place at different degrees of rotation.

The child seat section 20 may be locked in place when in the raised position, for example by a means such as a ratcheting device. As shown in FIG. 3, the exemplary embodiment of the present invention includes a means for engaging and securing the child seat section 20 in place when lowered, in the form of a receiving tongue 27 formed on the exterior front surface of the anterior section 16 that is received by a groove 28 formed on the underside of the child seat section 20. Alternatively, the positions of the groove 28 and the receiving tongue 27 may be reversed such that the groove 28 is formed on the anterior section and the receiving tongue 27 is formed on the underside of the child seat section 20.

According to one aspect of the invention, the child seat section 20 is substantially congruent to the anterior section 16, as shown in FIGS. 2 and 3, where the length, width, and/or thickness dimensions of the child seat section 20 are substantially equivalent to the dimensions of the anterior section 16.

Figure 7:
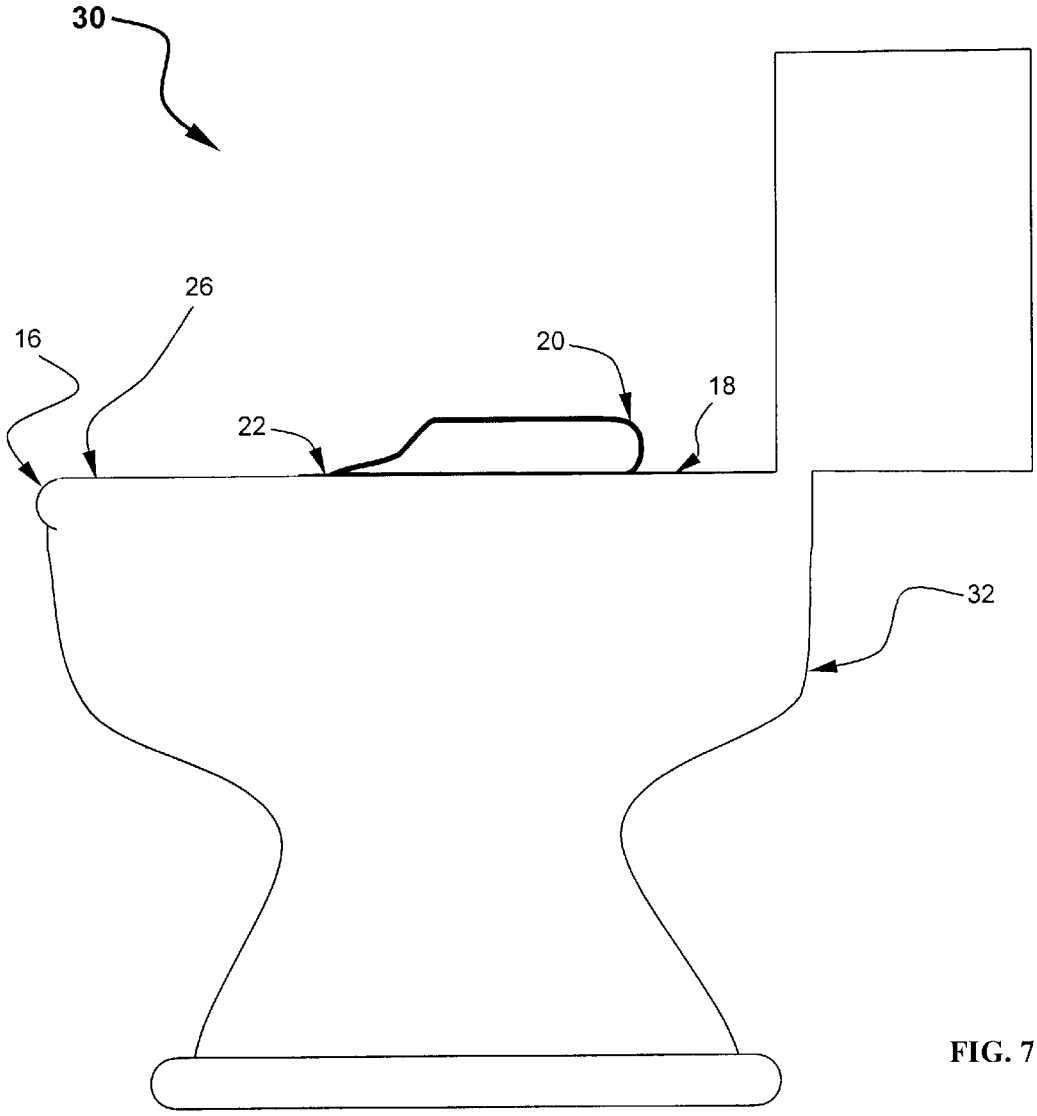
FIG. 7 is a side elevation of a preferred embodiment of a combination convertible toilet seat and toilet, with the child seat section in the raised position.

Referring now to FIG. 7, an alternative embodiment of the present invention is a combination convertible toilet seat and toilet 30. This embodiment is the equivalent of the convertible toilet seat 10, where the convertible toilet seat 10 is integral to a unitary toilet 32. In this embodiment, the unitary toilet 32 includes the anterior section 16 and the posterior section 18, while the child seat section 20 is a separate but attached component. The child seat section 20 is rotatably attached as detailed above.

Referring again to FIGS. 1 through 7, yet another embodiment of the present invention includes a method of converting toilet seat sizes. The conversion is accomplished by rotatably attaching a child seat section 20 to a posterior section 18 and above a receiving anterior section 16 of a convertible toilet seat 10. The user of the convertible toilet seat 10 raises the child seat section 20 by vertically rotating the child seat section 20 about an attaching means 22. By raising the child seat section 20, the user forms a child seat. The child seat has a smaller central aperture 24 in relation to the larger central aperture 14. The child seat also presents a preferably lower surface 26 upon which a child may sit. To form an adult seat, the user lowers the child seat section 20 until it rests atop the anterior section 16. The user thereby forms a conventional toilet seat with central aperture 14.

The convertible toilet seat 10 according to the exemplary embodiment of the present invention is installed and attached in the same manner as a conventional toilet seat and uses the same attaching means. The convertible toilet seat 10 can be used with conventional toilet seat lids.

In view of the forgoing, it is shown that convertible toilet seat is now provided which is substantially equivalent to a conventional toilet seat when configured for use by an adult; which reduces the size of the central aperture when configured for use by a smaller individual such as a child; and which is usable with conventional toilets and conventional toilet seat lids.

What is claimed is:

1. A convertible toilet seat comprising:

a substantially planar surface including a central aperture, said planar surface including:
a receiving anterior section; and
a posterior section;

a child seat section configured to be lowered so as to be received by said receiving anterior section without occluding the central aperture, and configured to be raised to lie flat upon the posterior section so as to occlude a portion of the central aperture thereby creating a relatively smaller central aperture in said toilet seat; and means for rotatably attaching said child seat section to said posterior section.

2. The convertible toilet seat of claim 1, wherein the central aperture is essentially the diameter of a central aperture in a conventional toilet.

3. The convertible toilet seat of claim 1, wherein said anterior section is configured to engage said child seat section.

4. The convertible toilet seat of claim 1, wherein said child seat section is of a thickness such that when received by said anterior section, the aggregate thickness of both said child seat section and said anterior section is substantially equivalent to the thickness of said posterior section.

5. The convertible toilet seat of claim 1, wherein said child seat section is generally congruent in shape to said anterior section.

6. The convertible toilet seat of claim 1, wherein said child seat section is secured to said anterior section when in its lowered position.

7. The convertible toilet seat of claim 6, wherein said child seat section is secured to said anterior section when in its lowered position by means of a groove formed on a front edge of the underside of said child seat section, where the groove receives a tongue formed on a front edge of the exterior of said anterior section.

8. The convertible toilet seat of claim 1, wherein said means for rotatably attaching said child seat section to said posterior section comprises a flexible material which provides a seamless juncture between said child seat section and said posterior section.

9. The convertible toilet seat of claim 8, wherein said flexible material is integrally molded as a portion of both the child seat section and the planar surface.

10. The convertible toilet seat of claim 8, wherein said flexible material is a double live hinge.

11. A combination convertible toilet seat and toilet, comprising:

a substantially planar surface that is integral to the toilet, said planar surface including:
a central aperture;
a receiving anterior section; and
a posterior section;

a child seat section configured to be lowered so as to be received by said receiving anterior section without occluding the central aperture, and configured to be raised to lie flat upon the posterior section so as to occlude a portion of the central aperture thereby creating a relatively smaller central aperture in said toilet seat; and means for rotatably attaching said child seat section to the posterior section.

12. The combination convertible toilet seat and toilet of claim 11, wherein the child seat section is of a thickness such that when received by the anterior section, the aggregate thickness of both the child seat section and the anterior section is substantially equivalent to the thickness of the posterior section.

13. The combination convertible toilet seat and toilet of claim 11, wherein the child seat section is generally congruent in shape to said anterior section.

14. The combination convertible toilet seat and toilet of claim 11, wherein the child seat section locks to said anterior section when in its lowered position.

15. The combination convertible toilet seat and toilet of claim 11, wherein the central aperture is essentially the diameter of a central aperture in a conventional toilet.

16. The combination convertible toilet seat and toilet of claim 11, wherein the anterior section is molded to receive said child seat section.

17. A method of converting toilet seat sizes, comprising:

providing a toilet seat with a central aperture;

providing a child seat section above an anterior section of said toilet seat, said child seat section being rotatably attached to said toilet seat such that when lowered, the child seat section is received by said anterior section without occluding the central aperture, and such that when raised, the child seat section lies flat upon the posterior section;

wherein raising said child seat section occludes a portion of the central aperture to create a relatively smaller central aperture in said toilet seat; and wherein lowering said child seat section receivably onto the anterior section exposes the entire central aperture in said toilet seat.

18. The method of claim 17, wherein the larger central aperture is substantially equivalent in size to the central aperture of a conventional toilet.

19. The method of claim 17, further comprising locking the child seat section to said anterior section when in its lowered position.

20. The method of claim 17, further comprising rotatably attaching said child seat section to said toilet seat with a flexible material that provides a seamless juncture between said child seat section and said posterior section of said toilet seat.

21. The method of claim 20, wherein rotatably attaching comprises integrally molding the flexible material as a portion of both the child seat section and the planar surface.

* * * * *